US010641581B2

(12) United States Patent
Lamotte et al.

(10) Patent No.: US 10,641,581 B2
(45) Date of Patent: May 5, 2020

(54) WEAPON LAUNCHING TUBE STRUCTURE, AND NAVAL PLATFORM COMPRISING AT LEAST ONE STRUCTURE OF SAID TYPE

(71) Applicant: NAVAL GROUP, Paris (FR)

(72) Inventors: Arnaud Lamotte, Ruelle sur Touvre (FR); Johan Raffoux, Ruelle sur Touvre (FR); Laurent Lavoix, Ruelle sur Touvre (FR)

(73) Assignee: NAVAL GROUP, Paris (FR)

( * ) Notice: Subject to any disclaimer, the term of this patent is extended or adjusted under 35 U.S.C. 154(b) by 0 days.

(21) Appl. No.: 16/079,870

(22) PCT Filed: Feb. 24, 2017

(86) PCT No.: PCT/EP2017/054403

§ 371 (c)(1),
(2) Date: Aug. 24, 2018

(87) PCT Pub. No.: WO2017/144700

PCT Pub. Date: Aug. 31, 2017

(65) Prior Publication Data

US 2019/0063872 A1 Feb. 28, 2019

(30) Foreign Application Priority Data

Feb. 25, 2016 (FR) ..... 16 00319

(51) Int. Cl.
*F41F 3/08* (2006.01)
*F41F 3/042* (2006.01)
*F41F 3/052* (2006.01)

(52) U.S. Cl.
CPC ..... *F41F 3/08* (2013.01); *F41F 3/042* (2013.01); *F41F 3/052* (2013.01)

(58) Field of Classification Search
CPC ..... F41F 3/08; F41F 3/052; F41F 3/00; F41F 3/10; F41F 3/04; F41F 3/044; F41F 3/042; B29C 48/12
USPC ..... 114/238, 20.1, 239; 89/1.816
See application file for complete search history.

(56) References Cited

U.S. PATENT DOCUMENTS 3,160,061 A * 12/1964 Moy ..... F41F 3/07 89/1.816
3,425,586 A * 2/1969 Petters ..... F41F 3/052 220/23.4
3,769,876 A * 11/1973 Haas ..... F41F 3/042 89/1.8
5,115,711 A * 5/1992 Bushagour ..... F41F 3/042 89/1.816

(Continued)

FOREIGN PATENT DOCUMENTS

DE 544 173 2/1932
DE 544173 C * 2/1932 ..... F41F 3/10
FR 2 130 912 11/1972

OTHER PUBLICATIONS

International Search Report, PCT/EP2017/054403, dated May 8, 2017.

*Primary Examiner* — John Cooper
(74) *Attorney, Agent, or Firm* — Young & Thompson

(57) ABSTRACT

A weapon launching tube structure, and in particular a torpedo launching tube structure, includes a tube inside which weapon guiding slides are mounted at regular intervals around the weapon. The slides are made from a single slide blank obtained by an extrusion process.

16 Claims, 5 Drawing Sheets

(56) References Cited

U.S. PATENT DOCUMENTS

| | | | | | |
|---|---|---|---|---|---|
| 5,353,677 | A * | 10/1994 | Kennedy | F41F 3/052 | 89/1.8 |
| 6,079,310 | A * | 6/2000 | Yagla | F41F 3/0413 | 89/1.816 |
| 7,128,013 | B1 * | 10/2006 | Plunkett | F41F 3/052 | 114/238 |
| 2009/0094929 | A1 * | 4/2009 | Carlson | E04F 15/10 | 52/656.2 |
| 2009/0158990 | A1 * | 6/2009 | Owen | B63G 8/32 | 114/316 |
| 2016/0167278 | A1 * | 6/2016 | Park | B29C 48/92 | 425/145 |

* cited by examiner

WEAPON LAUNCHING TUBE STRUCTURE, AND NAVAL PLATFORM COMPRISING AT LEAST ONE STRUCTURE OF SAID TYPE

BACKGROUND OF THE INVETION

Field of the Invention

The present invention relates to a weapon launching tube structure, and in particular a torpedo launcher.

It also relates to a naval platform comprising at least one such structure.

Description of Related Art

More particularly, the invention relates to such a structure in particular for a surface building, and which comprises a tube in which weapon guiding slides are mounted.

These slides are regularly distributed in the tube around the weapon, and in particular the torpedo.

These slides are in fact intended to receive and correctly place the weapon in the tube, so that it may be fired or launched.

In general, these slides are made from metal sheets that are rolled, then bent at the ends, so as to press against the inner wall of the tube.

These slides are also provided with fastening means, for example by screwing, from the outside of the tube.

Fastening screws in fact cooperate with tapped holes arranged in bosses extending between the slides and the tube.

In the applications in particular to surface buildings mentioned above, the tube also includes, near its rear end, an inspection or access hatch from the top of the tube, to interfacing means of the torpedo.

This hatch then allows operators to access interfacing means of the torpedo, for example to connect various elements thereto, for the preparation and initiation of firing.

One can see, however, that this has a certain number of drawbacks, since the corresponding slides must also be provided with recess-forming means, making it possible to delimit and free an access passage to these interfacing means of the torpedo.

Indeed, the slides must not prevent access to the interfacing means.

It is then not possible to standardize the manufacture of these slides, since three different types of slides must be provided.

Indeed, it is necessary to provide a first type of lower slide intended to form the lower lateral slides of the tube, which are symmetrical, and two types of upper slide intended to form the left and right upper lateral sides of the tube, which must have complementary shapes and free an access passage to the interfacing means of the weapon from the hatch of the tube.

All of this results in manufacturing and management complexity of these slides and a relatively high manufacturing cost thereof.

BRIEF SUMMARY OF THE INVENTION

The invention therefore aims to resolve these problems.

To that end, the invention relates to a weapon launching tube structure, and in particular a torpedo launching tube structure, comprising a tube inside which weapon guiding slides are mounted at regular intervals around the weapon, characterized in that the slides are made from a single slide blank obtained by an extrusion process.

The structure according to the invention may include one or more of the following features, considered alone or according to any technically possible combination(s):

- the slide blank is obtained by an aluminum extrusion process;
- the slide blank has a section with a curved profile to marry the contour of the weapon, at each end of this profile, a bent portion for bearing on the inner wall of the tube, and in its intermediate portion, a withdrawn foot;
- the withdrawn foot is provided asymmetrically between the bent bearing portions of the blank;
- the tube includes four slides, including two lateral lower slides and two lateral upper slides;
- it includes, in its upper part, at least one access hatch to means forming an interface of the weapon and in that cutouts are formed in the upper slides at this hatch, between a bent bearing portion on the inner wall of the tube and the withdrawn foot;
- covers are provided to close the open ends of the slides;
- the slides are associated with screwing means from the outside of the tube, making it possible to fasten the latter in this tube;
- the slides include reinforcing and maintaining bosses at the screwing means.

According to another aspect, the invention also relates to a naval platform comprising at least one such structure.

BRIEF DESCRIPTION OF THE DRAWINGS

The invention will be better understood upon reading the following description, provided solely as an example, and in reference to the appended drawings, in which.

DETAILED DESCRIPTION OF THE PREFERED EMBODIMENTS

Figure 1:
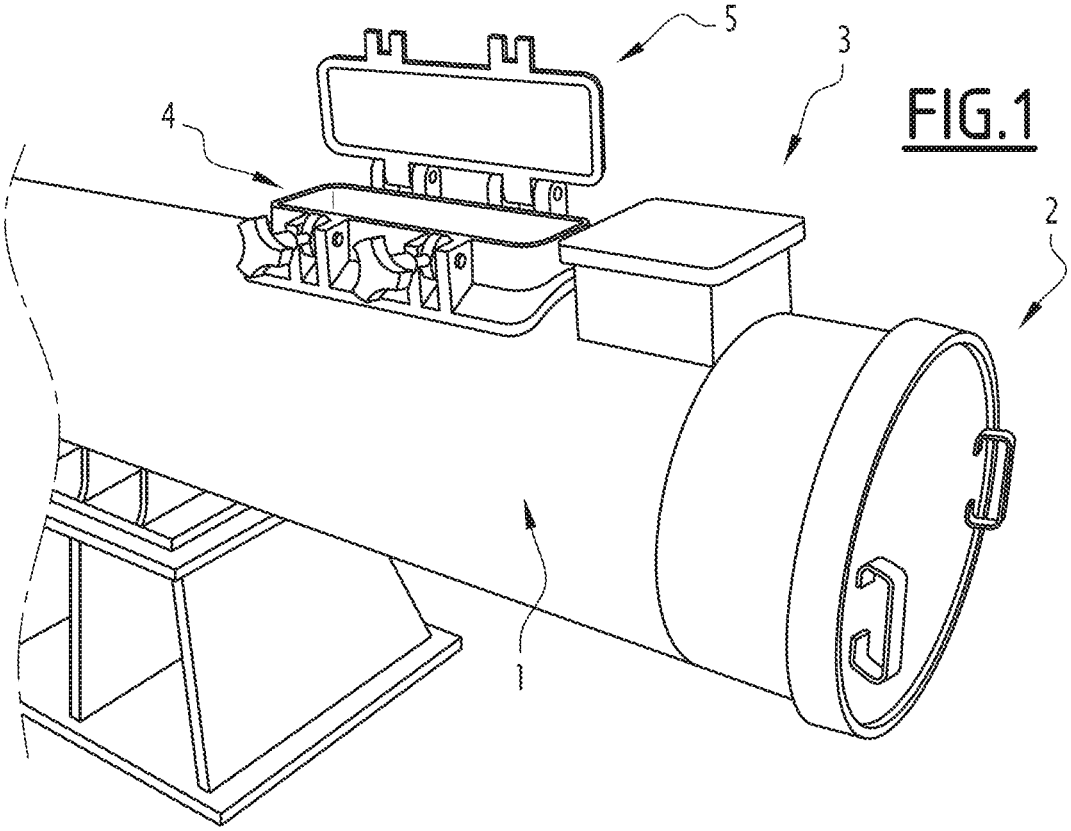
FIG. 1 shows a perspective view of part of a weapon lunching tube, and in particular a torpedo launching tube, of the state of the art.

FIG. 1 shows a weapon launching tube, and in particular a torpedo launching tube, of the state of the art.

Such a structure is intended to be mounted on a naval platform, such as a surface building.

A building, in particular such as a corvette or frigate or the like, may include several tube structures as described.

Such a structure is designated by general reference 1 in this FIG. 1, and includes, at one of its ends, a closing cover designated by general reference 2.

At this point of the tube, a mechanism is also provided for initiating/arming the expulsion, designated by general reference 3.

In the upper part of the structure 1, an inspection and access hatch is also provided to the interfacing means of the weapon placed in the tube.

In this FIG. 1, this hatch is designated by general reference 4, and is for example associated with a closing cover designated by general reference 5.

As previously indicated, this access hatch 4 allows operators to access interfacing means of the weapon, for example to connect any elements thereto.

Figure 2:
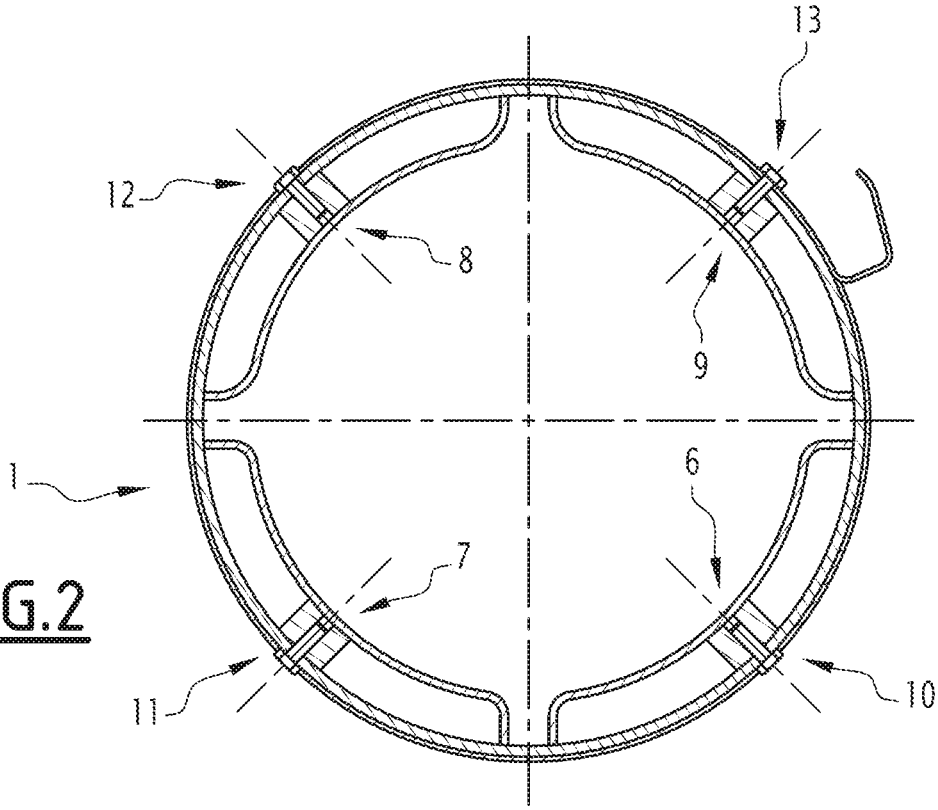
FIGS. 2 and 3 illustrate the production of slides in the composition of a tube structure of the state of the art.

As illustrated in FIG. 2, as a general rule, four slides are used to guide the weapon in the tube 1, these four slides being regularly distributed in this tube around the weapon.

Figure 3:
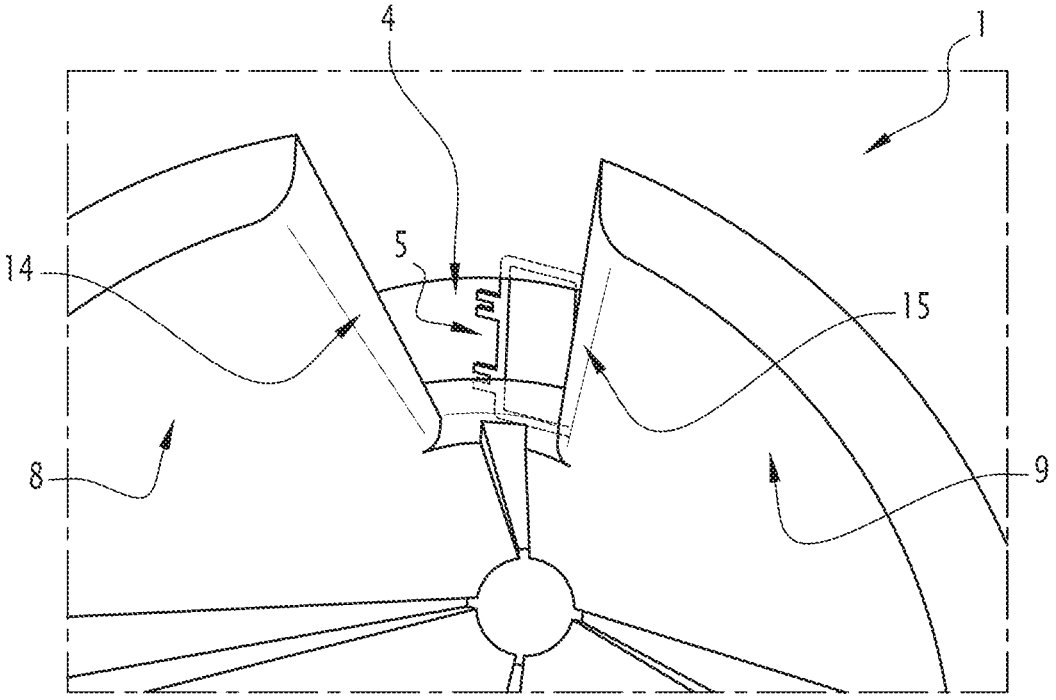

In these FIGS. 2 and 3, the tube is still designated by general reference 1 and the slides are designated by general references 6, 7, 8 and 9.

Indeed, FIG. 2 shows right 6 and left 7 lateral lower slides and left 8 and right 9 upper lateral slides.

In FIG. 2, the tube 1 is cut in a location where all four slides have an identical profile.

These slides 6, 7, 8 and 9 are then fastened via screwing means on the tube 1 by the outside thereof.

As previously indicated, these screwing means for example comprise screws suitable for cooperating with tapped holes of complementary bosses of these slides 6, 7, 8 and 9.

These fastening means by screwing are designated by general references 10, 11, 12 and 13 for the slides 6, 7, 8 and 9.

At the access hatch 4 of the tube 1, and as illustrated in FIG. 3, the left and right upper lateral slides, respectively 8 and 9, include recesses 14 and 15, respectively, together making it possible to define a passage across from the hatch 4 of the tube 1, to allow the operators to access the interfacing means of the weapon through this hatch from the outside of the tube.

One can see that these recesses 14 and 15 are extremely complex to produce and require making three different slide profiles, as previously indicated.

Figure 4:
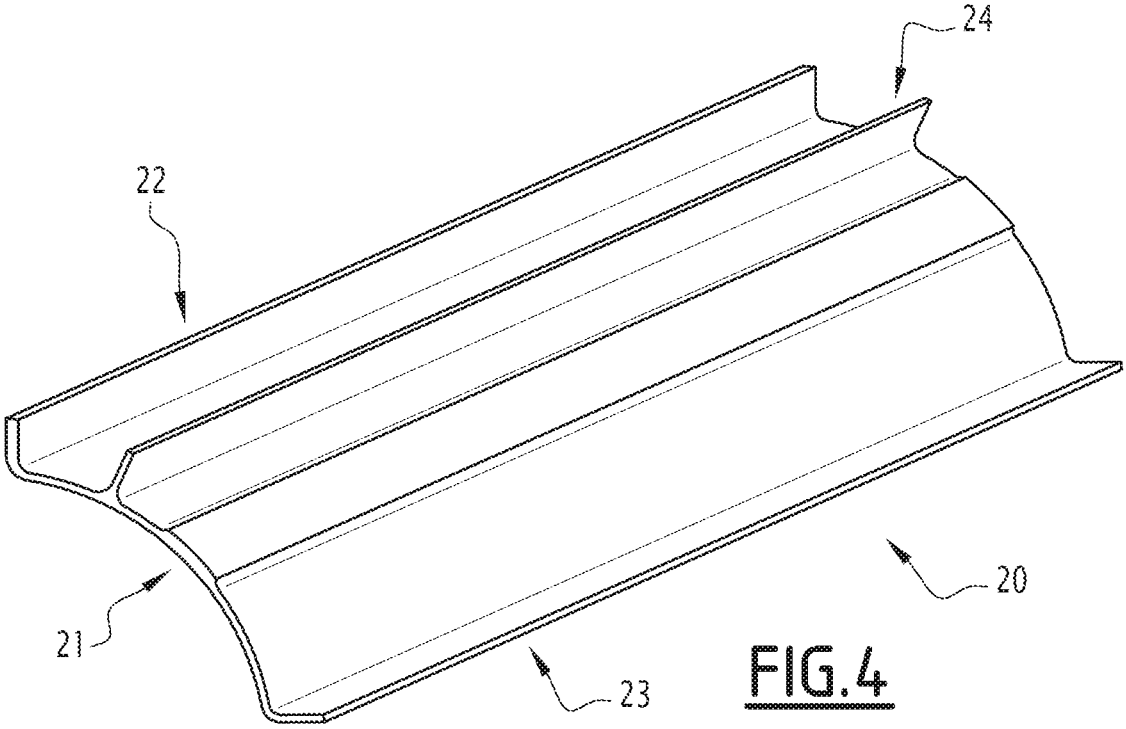
FIGS. 4 and 5 respectively show a perspective view and a side view of a slide blank in the composition of a tube structure according to the invention.
Figure 5:
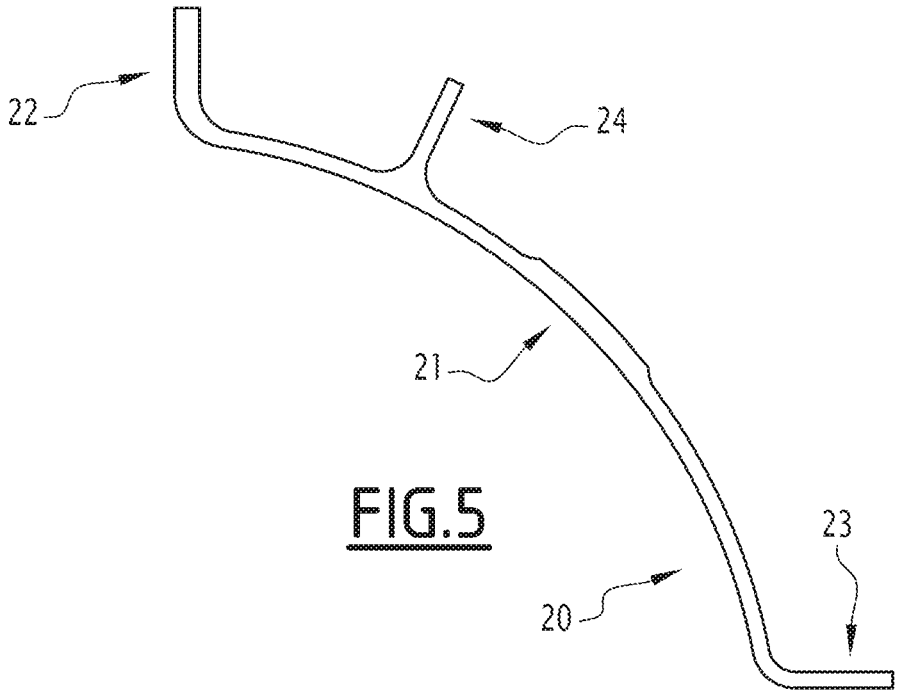
Figure 6:
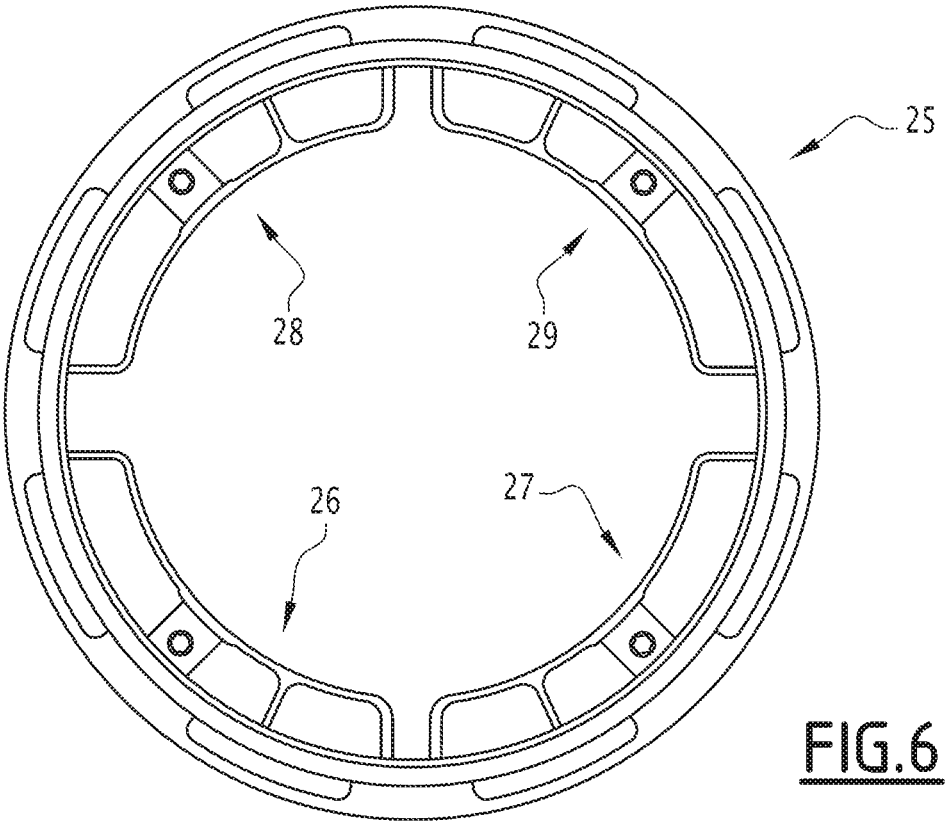
FIG. 6 shows a sectional side view illustrating the installation of slides in a tube structure according to the invention.

To resolve these problems and as illustrated in FIGS. 4, 5 and 6, in the weapon launching tube structure 1 according to the invention, the slides are made from a same slide blank obtained by an extrusion process.

More particularly, these slides can be obtained by an aluminum extrusion process or any other appropriate material.

Such a blank may indeed very simply come from an extruder in a traditional manner.

A first example embodiment of such a slide is given in FIGS. 4 and 5.

In these FIGS. 4 and 5, the slide blank is designated by general reference 20.

This blank 20 then has a section with a curved profile, designated by general reference 21, to marry the contours of the weapon.

This curved profile 21 comprises, at each of its ends, a bent bearing portion on the inner wall of the tube 1, which is then referred to by references 22 and 23, and in its intermediate part, for example, a withdrawn bearing foot, designated by general reference 24.

Indeed, as illustrated, the withdrawn foot 24 is provided asymmetrically between the bent bearing portions 22 and 23 of the blank 20.

One can then see, as illustrated in FIG. 6, that in a weapon launching tube structure according to the invention, as designated by general reference 25 in this figure, one also has weapon guiding slides around the weapon, and more particularly two left and right lower lateral slides and two left and right upper lateral slides.

These slides are designated by general references 26, 27, 28 and 29, respectively.

Thus, four slides are provided at regular intervals around the weapon in order to guide the weapon in the tube.

At the access hatch to the interfacing means of the weapon, it is simply provided to form passages, by cutting this profile in a corresponding manner, between the bent bearing portion 22 on the inner wall of the tube 25 and the corresponding withdrawn bearing foot 24 of the slide.

Figure 7:
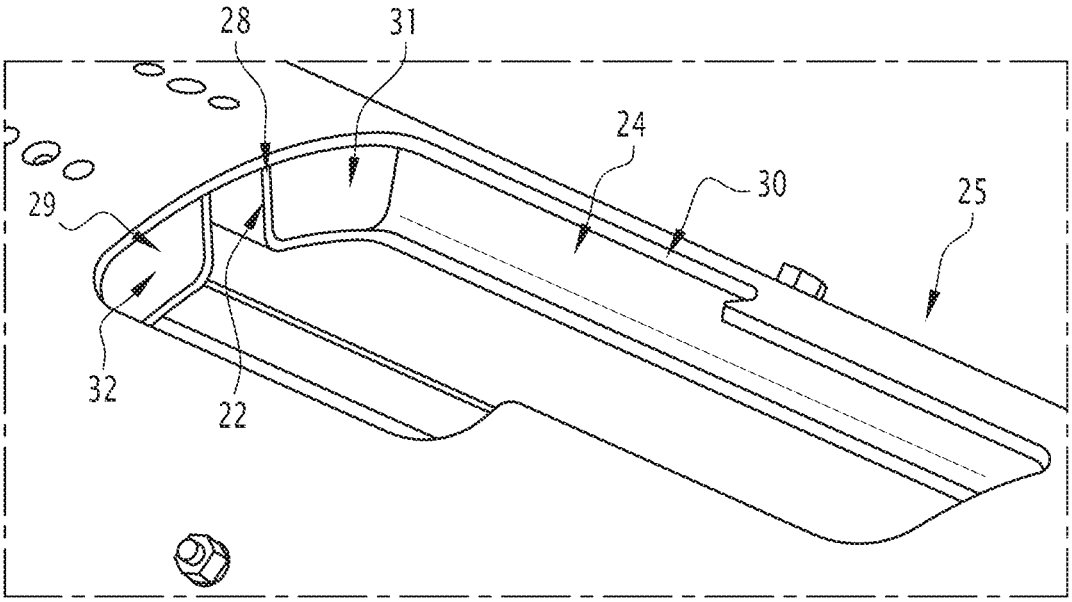
FIGS. 7 and 8 illustrate the access hatch at the interfacing means of the weapon in a tube structure according to the invention.
Figure 8:
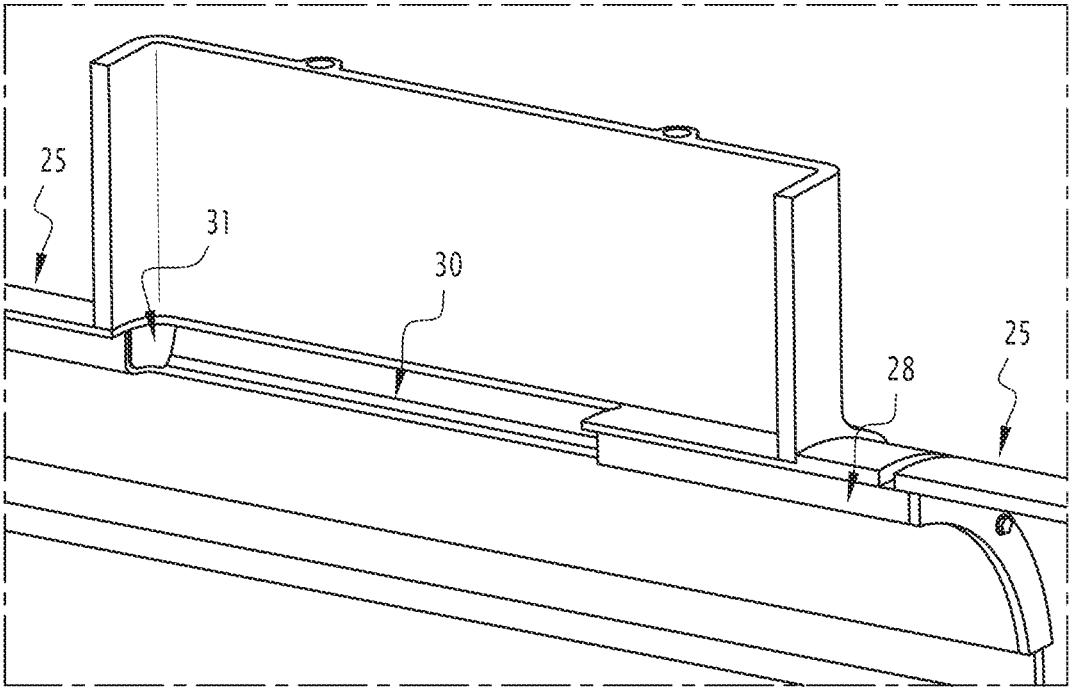

This is for example particularly visible in FIGS. 7 and 8, where one can see the torpedo launching tube 25 and the slides 28 and 29 of this tube, i.e., the left and right lateral upper slides.

The access hatch to the interfacing means of the weapon is in turn designated by general reference 30 in these figures.

Indeed, one can simply see that cutouts have been formed for example in the slides 28 and 29, and more visibly in these figures, between the bent bearing portion 22 of the slide 28 and the corresponding withdrawn bearing foot 24, to form the access passage.

Of course, stoppers or end covers can be provided to close off the open ends of the slides, for example the stoppers or covers 31 and 32 illustrated in FIG. 7.

It is thus possible for the slides to be made from a same slide blank obtained by an extrusion process and by simple cutting of portions thereof, to define the access passage to the interfacing means of the torpedo.

Figure 9:
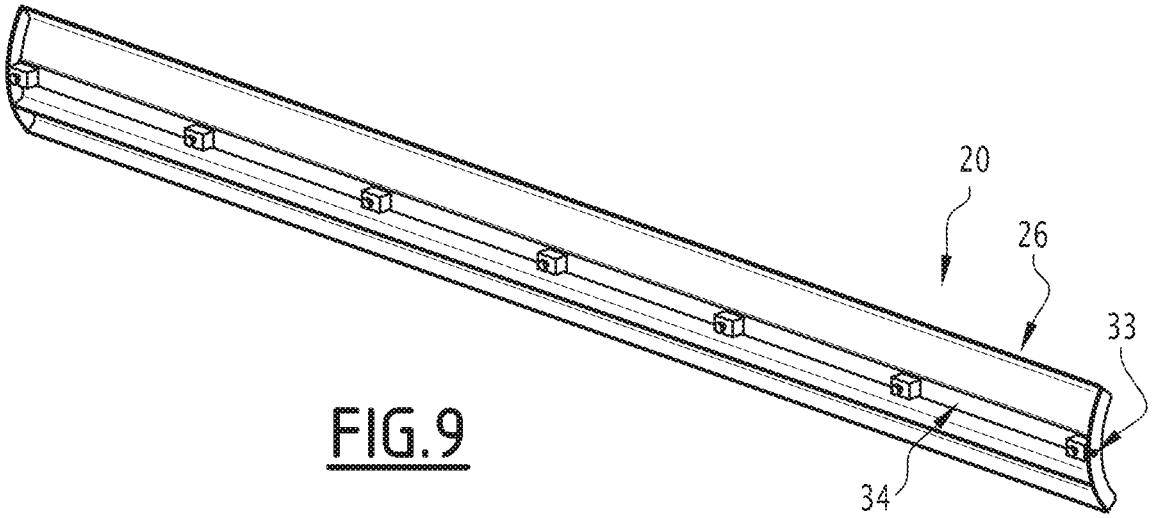
FIGS. 9 and 10 illustrate the fastening of slides in a tube structure according to the invention.
Figure 10:
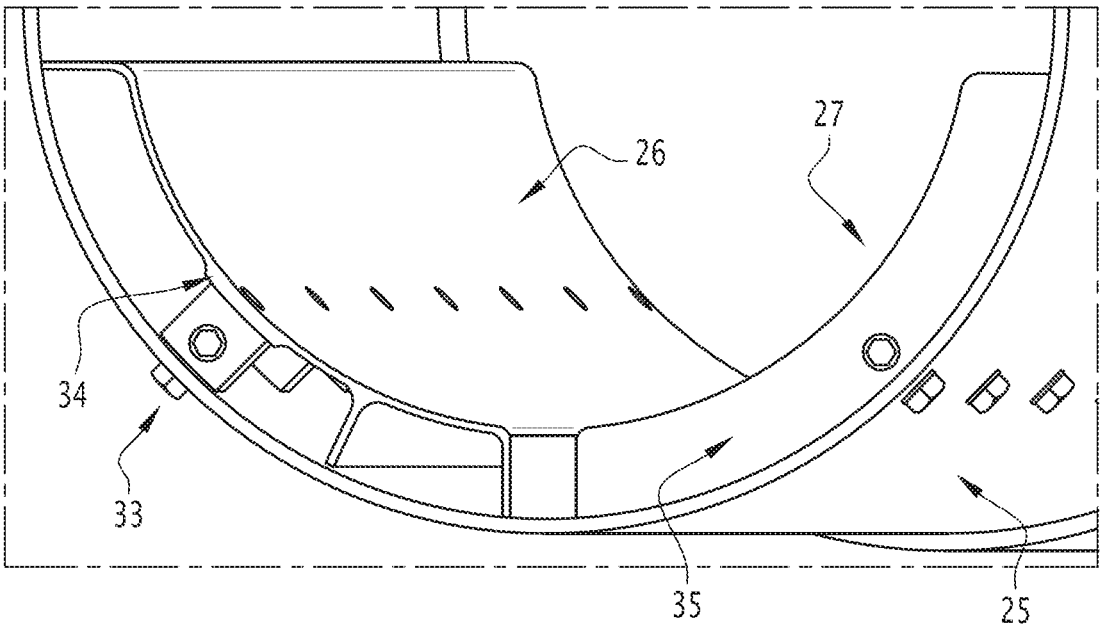

The fastening of these slides 26, 27, 28 and 29 on the tube 25 can also be done, as illustrated in FIGS. 9 and 10, via screwing means by the outside of the tube 25, making it possible to provide the fastening of these slides 26, 27, 28 and 29 in this tube 25.

Thus for example, FIGS. 9 and 10 show the fastening of the slides 26 and 27 on the tube 25, using screwing means, for example screwing means designated by general reference 33.

It will in particular be noted in this respect, and as shown in FIGS. 9 and 10 and other figures, that the profile of the slides can also be provided with raised portions or reinforcing and maintaining bosses, for example 34, making it possible to improve the reliability of the fastening.

FIG. 10 also shows a slide end cover or stopper designated by general reference 35.

One can then see, in light of these figures, that in the weapon launching tube structure according to the invention, the slides are all made from a same slide blank obtained by an extrusion process, for example from aluminum.

The particular shape of this blank with its bent bearing portions and its withdrawn foot makes it possible to produce cutouts therein very easily, to form the left and right upper lateral slides, which must define an access passage to the interfacing means of the torpedo across from the hatch of the tube.

This makes it possible to facilitate the production of these slides, simplify the management thereof, and reduce the manufacturing cost of the tube.

The invention claimed is:

1. A weapon launching tube structure comprising:

a tube inside which weapon guiding slides are mounted at regular intervals around a weapon, the slides being made from a single slide blank obtained by an extrusion process, wherein the slide blank has a section with a curved profile to marry the contour of the weapon, at each end of the profile, a bent portion to bear on the inner wall of the tube, and, in an intermediate portion thereof, a withdrawn foot.

2. The structure according to claim 1, wherein the slide blank is obtained by an aluminum extrusion process.

3. The structure according to claim 2, wherein the weapon guiding slides comprise four slides including two lateral lower slides and two lateral upper slides.

4. The structure according to claim 2, further comprising covers provided to close open ends of the slides.

5. The structure according to claim 2, wherein the slides are associated with screws from the outside of the tube, to enable the slides to be fastened in the tube.

6. The structure according to claim 1, wherein the withdrawn foot is provided asymmetrically between the bent bearing portions of the blank.

7. The structure according to claim 6, wherein the weapon guiding slides comprise four slides including two lateral lower slides and two lateral upper slides.

8. The structure according to claim 6, further comprising covers provided to close open ends of the slides.

9. The structure according to claim 1, wherein the weapon guiding slides comprise four slides including two lateral lower slides and two lateral upper slides.

10. The structure according to claim 9, wherein the tube has an upper part, and at least one access hatch to access an interface of the weapon is provided in the upper part, wherein cutouts are formed in the upper slides at the hatch, between a bent bearing portion on the inner wall of the tube and the withdrawn foot.

11. The structure according to claim 10, further comprising covers provided to close open ends of the slides.

12. The structure according to claim 9, further comprising covers provided to close open ends of the slides.

13. The structure according to claim 1, further comprising covers provided to close open ends of the slides.

14. The structure according to claim 1, wherein the slides are associated with screws from the outside of the tube, to enable the slides to be fastened in the tube.

15. The structure according to claim 14, wherein the slides include reinforcing and maintaining bosses at the screws.

16. A naval platform comprising:

at least one weapon launching tube structure comprising a tube inside which weapon guiding slides are mounted at regular intervals around the weapon, the slides being made from a single slide blank obtained by an extrusion process, wherein the slide blank has a section with a curved profile to marry the contour of the weapon, at each end of the profile, a bent portion to bear on the inner wall of the tube, and, in an intermediate portion thereof, a withdrawn foot.

* * * * *